US007395939B2

(12) United States Patent
Morris et al.

(10) Patent No.: US 7,395,939 B2
(45) Date of Patent: Jul. 8, 2008

(54) CAROUSEL FOR ELECTRIC TOOTHBRUSHES

(76) Inventors: James Bradford Morris, 2201 Cedar Circle Dr., Catonsville, MD (US) 21228; Lisa Beatrice Mears, 2201 Cedar Circle Dr., Catonsville, MD (US) 21228

( * ) Notice: Subject to any disclaimer, the term of this patent is extended or adjusted under 35 U.S.C. 154(b) by 0 days.

(21) Appl. No.: 11/546,797

(22) Filed: Oct. 12, 2006

(65) Prior Publication Data

US 2007/0084810 A1 Apr. 19, 2007

Related U.S. Application Data

(60) Provisional application No. 60/725,635, filed on Oct. 13, 2005.

(51) Int. Cl.
*A47B 81/02* (2006.01)
*A47F 7/00* (2006.01)

(52) U.S. Cl. ..... 211/65; 182/65; 182/70

(58) Field of Classification Search ..... 211/65, 211/60.1, 69.1, 71.01, 13.1, 199.009, 199, 211/70, 70.1, 115, 163; 248/110, 316, 923; 206/361; 220/736; 312/206
See application file for complete search history.

(56) References Cited

U.S. PATENT DOCUMENTS 4,534,471 A * 8/1985 Zahn et al. ..... 211/39
4,775,055 A * 10/1988 Morse ..... 211/78
5,074,421 A * 12/1991 Coulter ..... 211/78
5,076,444 A * 12/1991 Syms ..... 211/69.5
5,772,050 A * 6/1998 Shih ..... 211/39
6,053,338 A * 4/2000 Avery et al. ..... 211/65
6,182,839 B1 * 2/2001 Robbins et al. ..... 211/78
6,296,127 B1 * 10/2001 Tseng ..... 211/45
6,308,838 B1 * 10/2001 Endean ..... 211/37
D457,004 S * 5/2002 Brown, Jr. ..... D6/301
6,457,593 B1 * 10/2002 Hsu ..... 211/69.1
6,635,332 B1 * 10/2003 McArthur ..... 428/132
6,935,515 B1 * 8/2005 Sookoo ..... 211/65
D513,948 S * 1/2006 Martin ..... D7/707
7,083,070 B2 * 8/2006 McGuyer ..... 222/144
7,225,633 B2 * 6/2007 DeMars ..... 62/457.6

* cited by examiner

*Primary Examiner*—Katherine Mitchell
*Assistant Examiner*—Candace L. Bradford
(74) *Attorney, Agent, or Firm*—Ober/Kaler; Royal W. Craig

(57) ABSTRACT

The present invention is a universal electric toothbrush carousel that stores one or more electric and/or standard toothbrushes in a convenient rotary dispenser that is seated inside a walled base unit. The rotary dispenser comprises a top-mounted knob atop a clover-shaped disc, the disc being connected to a rod in a spindle-type manner. The bottom of the rod is connected to a concave base. In some embodiments, the concavity of the base collects and contains runoff. In other embodiments, the base may be defined by one or more drain holes to allow drainage of the residue. The rod offsets the disc from the base. The disc is four-leaf-clover-shaped and defined by alternate apertures (for holding standard and electric toothbrushes) and U-shaped recesses for holding electric toothbrushes. The spindle-type holder revolves around and holds one or more electric toothbrushes as well as standard toothbrushes in queued positions. The rotary dispenser may be seated in a freestanding base unit (various sizes and shapes) having a vertical notch for access to the queued toothbrushes, or may be seated on a wall mounting as desired.

11 Claims, 9 Drawing Sheets

CAROUSEL FOR ELECTRIC TOOTHBRUSHES

CROSS-REFERENCE TO RELATED APPLICATIONS

The present application derives priority from U.S. provisional application No. 60/725,635 filed 13 Oct. 2005.

BACKGROUND OF THE INVENTION

1. Field of the Invention

The present invention relates to bathroom storage accessories, and more particularly, to a storage carousel for multiple electric toothbrushes.

2. Description of the Background

The ordinary toothbrush has become a specialty item and there are now many different toothbrush configurations and designs geared toward different markets, such as children, senior citizens, etc. Conventional toothbrush holders, prevalent in many homes, are not able to accommodate the wide variety of new and changing designs.

Traditional toothbrush holders are either standalone (on the sink) or wall mounted. They include a container/base topped by a cover that has a plurality of apertures for insertion of the toothbrushes.

There are prior art holders that try to accommodate different toothbrushes, such as Menard U.S. Pat. No. 5,609,259 (1995). With this wall mount holder the toothbrush is directed into an L-shaped slot. This design holds a variety of toothbrushes securely. However, it is strictly for manual toothbrushes.

The first electric toothbrush was introduced by Squibb Pharmaceutical at the centennial of the American Dental Association in 1960. This was a rotation-type electric toothbrush, and despite studies that showed it marginally outperformed manual brushing, removing around 7% more plaque and leading to 17% less gum disease than manual brushes, there was a limited market due to the high cost.

A new generation of electric toothbrush, the sonic toothbrush, claims to have even greater cleaning potential. One popular brand of sonic toothbrush is the Sonicare manufactured by Philips. The Sonic Toothbrush was invented in 1983, and the brush head is capable of creating in excess of 30,000 brush strokes per minute. At this intense speed that the bristles vibrate, a secondary cleaning action occurs. It is able to provide energy to the liquids that surround the teeth.

Lately, the cost of these toothbrushes as well as their consumer appeal has increased dramatically. The major manufacturers are now able to produce an array of electric toothbrush models having differentiated housings, some for men, some for women, others having molded character housings for children, etc. All generally have an elongated neck leading to a head, and a pronounced body for containment of batteries or battery packs. ,None of the conventional toothbrush holders are adapted for the general footprint of electric toothbrushes, let alone the myriad variations, or a combination of electric and conventional toothbrush holders as described above. It is now common for a typical family to have seven or eight electric toothbrushes cluttering up their bathroom. After usage, electric toothbrushes are typically left upright or laid flat on the countertop surface. Such makeshift storage only adds to the veritable mountain of clutter that already occupies most limited bathroom counter space in most households, along with other items such as hair brushes, deodorants, toiletries and cosmetics. Moreover, the makeshift storage of electric toothbrushes usually results in water and toothpaste residue leaching out around the sink area. This leaves an unsanitary mess. The hodge podge of articles increases the risk of cross contamination between these items.

What is needed is a carousel holder that will accommodate any one or more from among the current variety of electric toothbrushes, with ample ability to accommodate the ever changing and evolving designs of electric toothbrushes, plus the capacity to store standard manual toothbrushes, and to hold them all in a secure, sanitary and easily accessible manner that is easy to use and keep clean. Such a holder would accommodate a plurality of electric as well as manual toothbrushes, would allow them to drain and runoff the drainage, thereby preventing toothpaste or water residue on counter tops.

SUMMARY OF THE INVENTION

It is therefore an object of the present invention to provide a convenient storage solution specifically designed as a carousel for securely storing any one or more electric toothbrushes alone or in combination with standard manual toothbrushes.

It is another general object to provide a practical universal electric toothbrush carousel that offers consumers a clean, readily accessible and conveniently placed storage solution for one or more bulky electric toothbrushes, with extra capacity for an array of conventional manual toothbrushes, facilitating more sanitary and convenient storage solution for family of adults as well as children.

It is another object to provide a toothbrush storage carousel that drains and catches water and residue runoff after use of the toothbrushes stored therein and thereby reducing cross-contamination.

It is another object to provide a toothbrush storage carousel as described above having a highly attractive aesthetic appearance.

It is a more specific object to provide a toothbrush storage carousel that incorporates a spindle-type holder that revolves around and holds one or more electric toothbrushes plus standard toothbrushes in a convenient, easily reachable, queued position.

It is still another object to provide a spindle holder as described above that can be rotated within various sizes and shapes of base units including rectangular, square, triangular, circular, etc. for aesthetic appeal.

It is still another object to provide a convenient wall mount for the spindle-type holder described above as an alternative to the freestanding base unit.

Still another object is to provide a universal electric carousel that is simple and scalable (i.e. it may vary in size to fit various toothbrush dimensions).

It is another object to provide a universal electric carousel that is light in weight, pleasant to use, and relatively inexpensive to produce.

In accordance with the foregoing objects, the present invention is a universal carousel for storing any one or more electric toothbrushes, with inherent capacity for one or more electric toothbrushes alone or in combination with a plurality of standard toothbrushes. Indeed electric toothbrushes feature a much wider base than the standard toothbrushes in order to accommodate internal batteries and inner mechanics, and this carousel is designed to hold both electric and standard toothbrushes. The electric toothbrush carousel includes a rotary dispenser that is seated inside a walled base unit. The rotary dispenser comprises a top-mounted knob atop a clover-shaped disc, the disc being connected to a rod in a spindle-type manner. The bottom of the rod is connected to a base, the rod offsetting the disc from the base. The base is concave to collect reside, and may be defined by one or more holes for drainage of the residue. The disc is four-leaf-clover-shaped and defined by alternate apertures (for holding standard and electric toothbrushes) and U-shaped recesses for holding electric toothbrushes. The spindle-type holder revolves around and holds the electric toothbrushes as well as standard toothbrushes in queued positions. The rotary dispenser may be seated in a freestanding base unit (various sizes and shapes) having a vertical notch for access to the queued toothbrushes, or may be freestanding on a counter, or seated on a wall mounting as desired.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
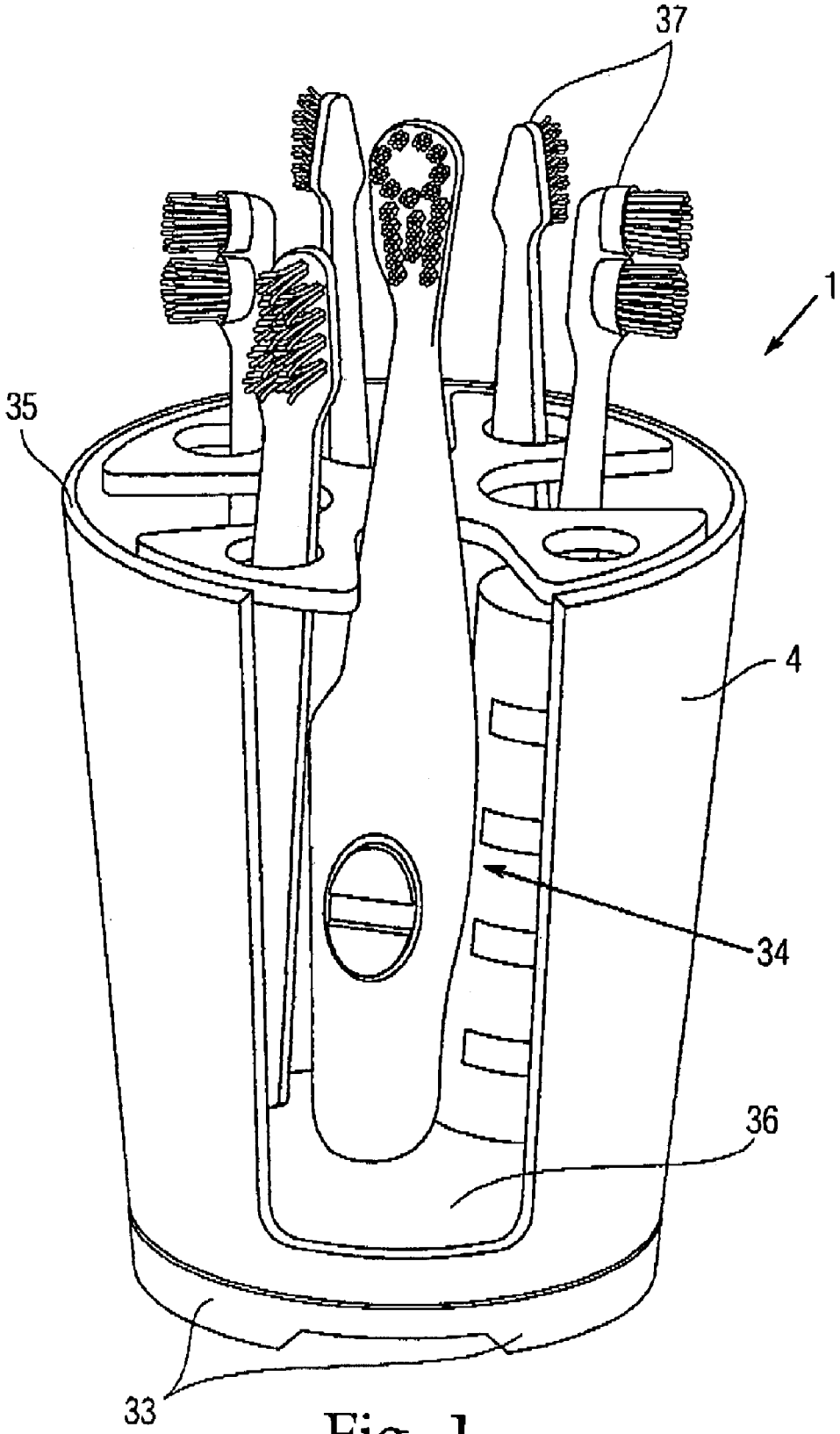
FIGS. 1 and 2 are perspective and exploded views, respectively of the preferred embodiment of the carousel 1.

The present invention is a universal electric toothbrush carousel 1 that stores one or more electric toothbrushes of any size, alone or in combination with an array of standard toothbrushes, in a convenient rotary queue dispenser 2. The invention is herein described in the context of a universal electric toothbrush carousel 1 adapted for storing one-to-eight electric toothbrushes plus a variety of standard manual toothbrushes, although one skilled in the art should understand that the illustrated toothbrush carousel 1 may be scaled to accommodate as many as sixteen electric toothbrushes without departing from the scope and spirit of the invention. The toothbrush storage carousel 1 incorporates a unique spindle-type rotary dispenser 2 that revolves within an enclosed open-topped base 4 to hold and dispense electric toothbrushes as well as standard toothbrushes in queued positions. The rotary dispenser 2 may be rotatably seated within a freestanding base unit 4 of various sizes and shapes (rectangular, square, triangular, circular, etc. for aesthetic choice), or alternatively, a wall-mount 20 as will be described.

Figure 2:
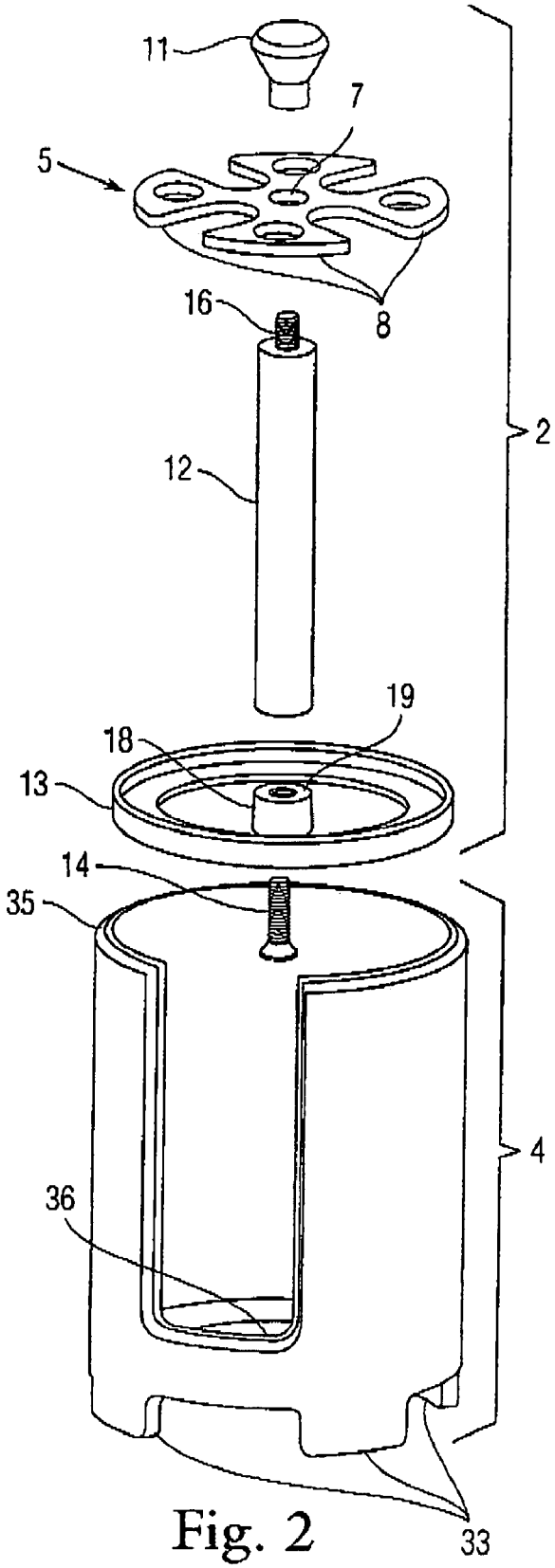

FIGS. 1 and 2 are perspective and exploded views, respectively of the preferred embodiment of the carousel 1. The carousel 1 comprises a rotary dispenser 2 rotatably seated within a freestanding base unit 4. The base unit 4 comprises an open-topped hollow geometrical enclosure having a slot 34 which extends vertically along the front wall of base unit 4 from an upper rim 35 down to a closed bottom 36. The entire rotary dispenser 2 rotates by manual turning to queue a brush 37 through slot 34 for convenient access. The base unit 4 is molded into a geometric (here cylindrical) shape with supporting feet 33 beneath the base 36 of the bottom of the base unit 4 (preferably three or four feet 33). Additionally, the base unit 4 may be formed in various shapes and rely on planar bottom 36 rather than legs 33.

Figure 4:
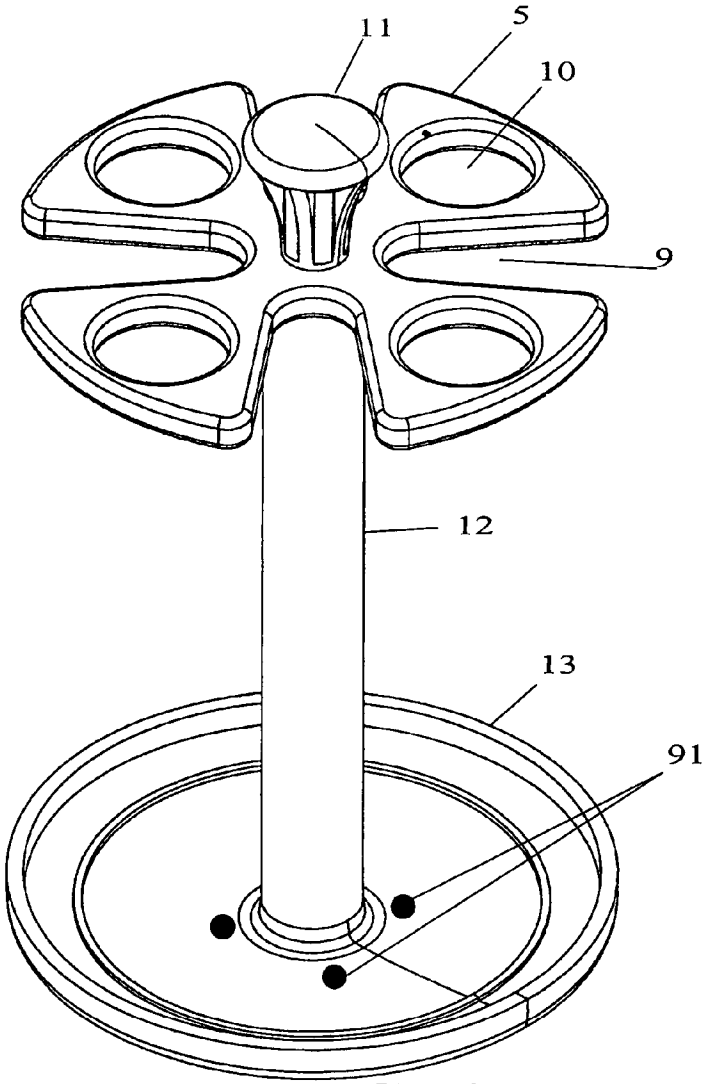
FIGS. 3 and 4 are side, and front assembled views, respectively of the rotary dispenser 2.
Figure 3:
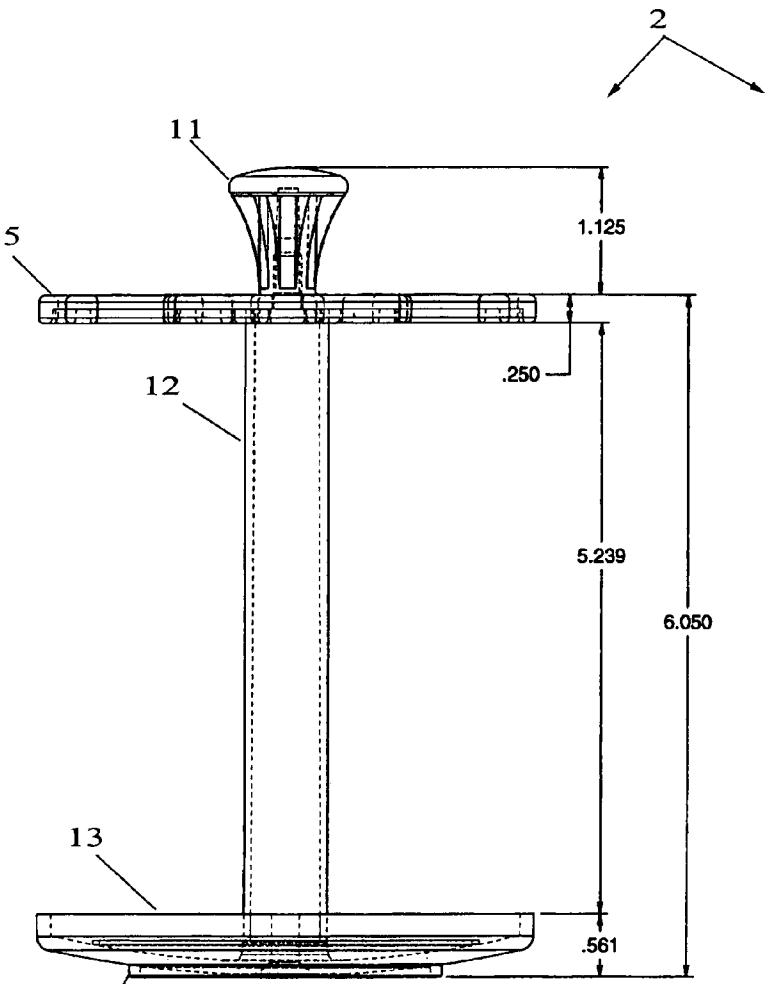

FIGS. 3 and 4 are side, and front assembled views, respectively of the rotary dispenser 2. With collective reference to FIGS. 2-4, the rotary dispenser 2 comprises a clover-shaped (generally cylindrical slotted) disc 5 having a centrally-defined aperture 7 for insertion of a screw 16 protruding from (and otherwise embedded axially in) a rod 12. Screw 16 passes through clover disc 5 and an ornate knob 11 is mounted there atop to compress the clover disc 5 between knob 11 and rod 12. The other end of the cylindrical rod 12 is affixed by a cap screw 14 to an upwardly-concave circular base 13. The concave base 13 has an upwardly protruding concentric neck 18 having a centrally defined aperture 19 therein. The neck 18 forms a reinforcement for a through-bore for the cap screw 14. The cap screw 14 is inserted through the aperture 19 from the bottom surface of the base 13, and is threaded into the bottom of the rod 12 to secure the entirety of the rotary dispenser 2 together. One skilled in the art should understand that the cap screw 14 may be eliminated by integrally-molding the rod 12 to the neck 18. The clover disc 5 is preferably a molded acrylic or other plastic component, here formed with four separated leaves 8 to give the appearance of a four-leaf clover. Again, the carousel 1 may be scaled in diameter and in number of leaves to accommodate more (as many as sixteen electric toothbrushes with sixteen leaves) without departing from the scope and spirit of the invention In use of the carousel 1, the pre-assembled rotary dispenser 2 is inserted into the preform freestanding base unit 4. A brush 37 is queued to the slot 34 in the base unit 4 by turning the knob 11 which rotates the entire rotary dispenser 2. The user can easily lift the brush 37 in the queued position from the slot 34, or insert brushes 37 for storage. The spindle-type rotary dispenser 2 of FIG. 3 revolves around and holds one or more electric toothbrushes (in U-shaped notches 9) plus four standard or electric toothbrushes (in apertures 10) in a convenient, easily reachable, queued position. The spindle-type holder 2 was designed especially to accommodate the wide base of the electric toothbrush which houses internal batteries and internal mechanics.

Figure 6:
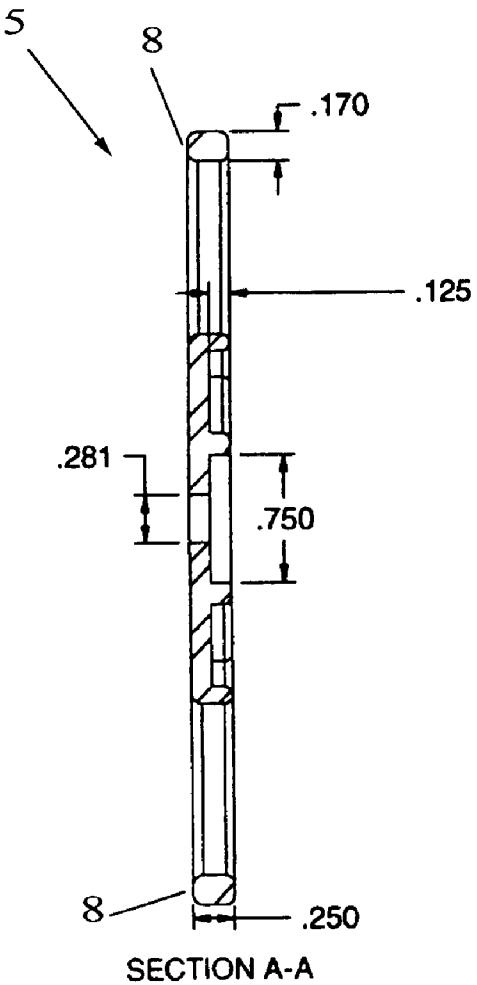
FIGS. 5-6 are top and cross-sectional views of the clover disc 5 with exemplary dimensions.
Figure 5:
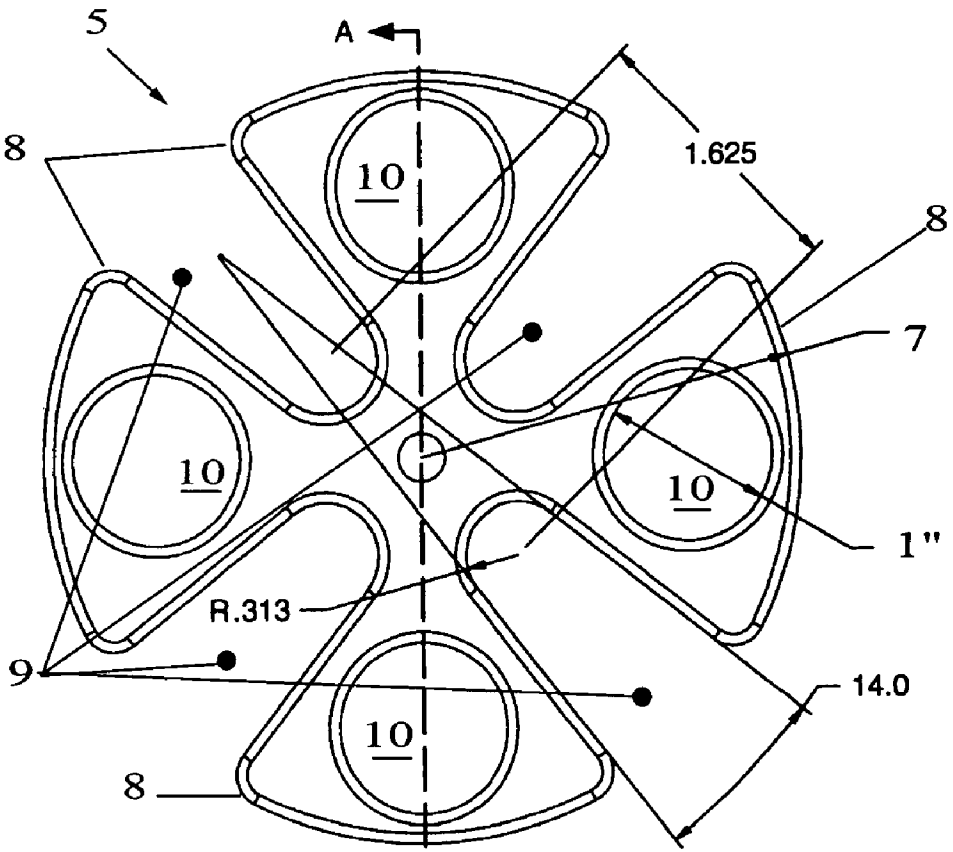

FIGS. 5-6 are top and cross-sectional views of the clover disc 5 with exemplary dimensions. The clover disc 5 is approximately 0.250 inches thick with a two-tier central aperture 7 having a small diameter on one (top) side of approximately 0.281 inches and a larger diameter on the other (bottom) side of approximately 0.750 inches. Four leaves 8 of clover disc 5 protrude from a central section, and the leaves 8 are each separated by a U-shaped recess 9 defined between flanking leaves 8 of the clover disc 5 (four recesses 9 total, though disc 5 may be scaled in diameter to accommodate more recesses 9 and number of leaves to store more (as many as sixteen electric toothbrushes with sixteen leaves) without departing from the scope and spirit of the invention). The radius of curvature at the trough of each U-shaped recess 9 is on the order of approximately 0.313 inches, and the edges of the recesses 9 flare outward at 14 degrees to an opening from the clover disk 5 of about 1-1.2 inches. Each of the leaves 8 of clover disc 5 is formed with a centrally defined aperture 10 to receive the neck of a manual (or electric) toothbrush 37. The diameter of each aperture 10 in the clover disc 5 is approximately one inch. The radius of the clover disc 5 is 2.250 inches. The length measured from the center of the aperture 7 to the center of each aperture 10 is 1.580 inches.

Figure 7:
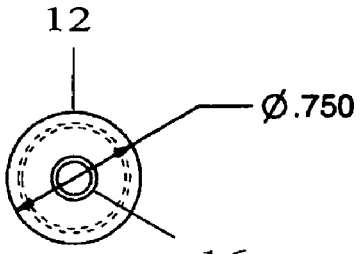
FIGS. 7-9 are cut-away, cross-sectional, and top views, respectively of the rod 12.
Figure 8:
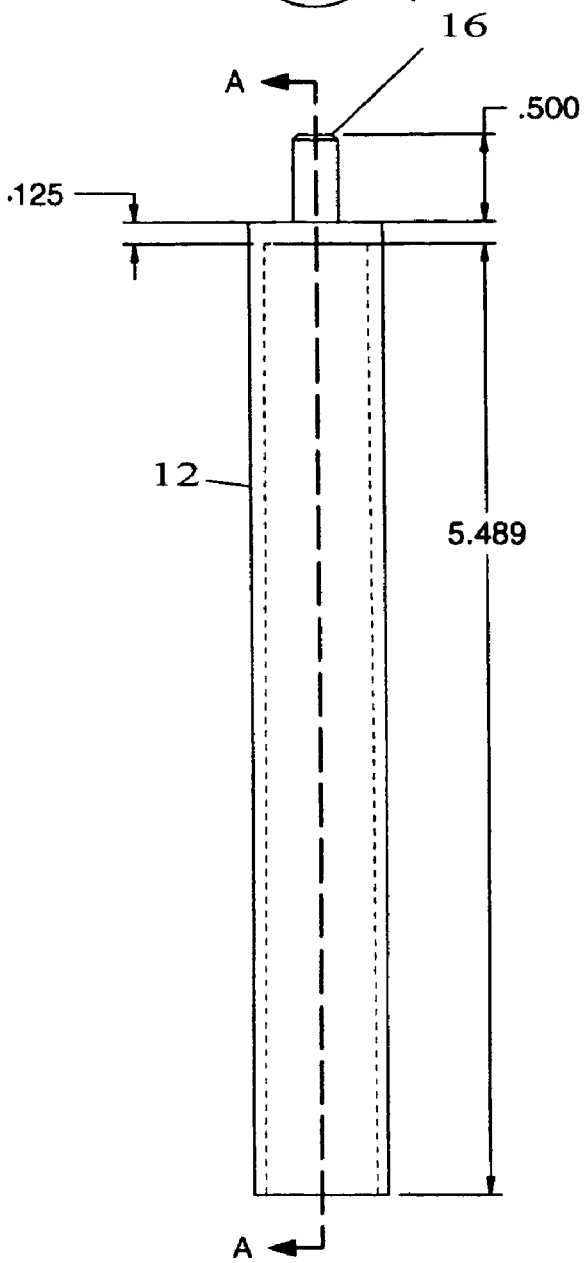
Figure 9:
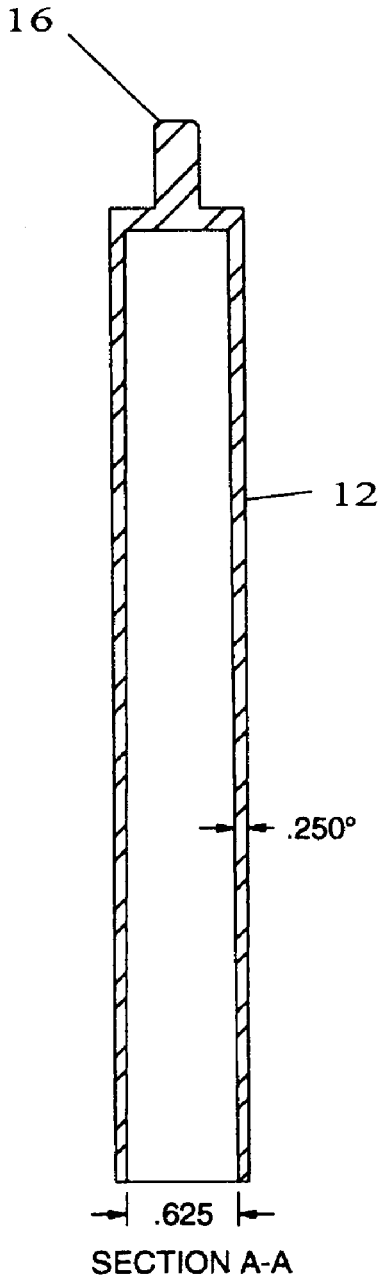

FIGS. 7-9 are cut-away, cross-sectional, and top views, respectively of the rod 12. The hollow body 12 has a diameter of 0.750 inches, and a length of 5.489 inches. The length of the threaded rod 16 is 0.500 inches.

Figure 11:
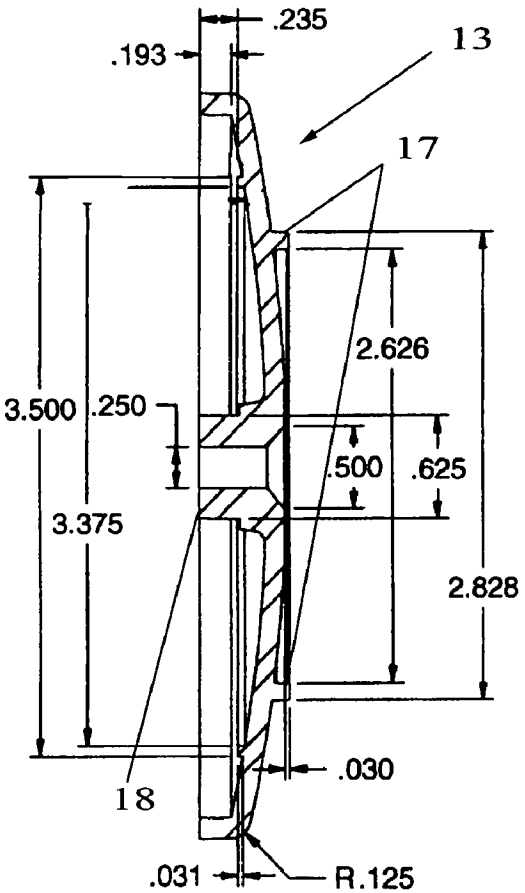
FIGS. 10-11 are top and side cross-sectional views, respectively of the concave base 13.
Figure 10:
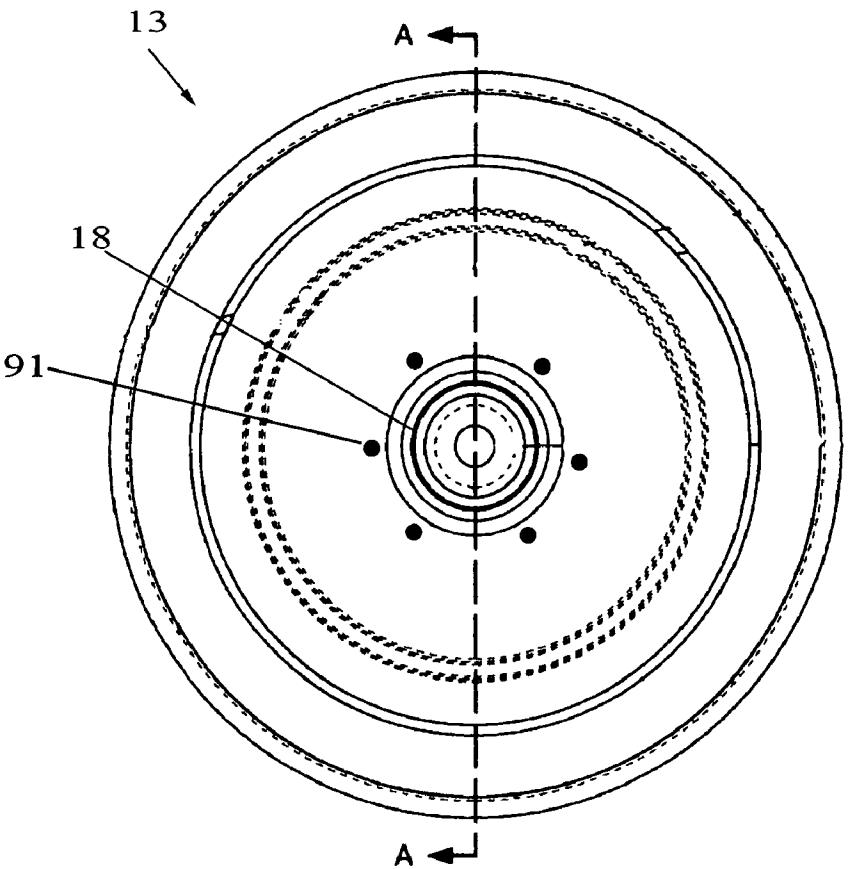

FIGS. 10-11 are top and side cross-sectional views, respectively of the concave base 13. The neck 18 of the base 13 has inner diameter of 0.250 inches and outer diameter of 0.500 inches. The outer diameter of the base 13 is 4.500 inches. The height of the base 13 is 0.561 inches. The bottom surface of the base 13, while concave, is defined by a downwardly protruding annular lip 17 to seat the base against the closed bottom 36 of base unit 4 and yet facilitate rotation thereon. As seen in FIG. 2, the outer diameter of the base 13 generally conforms to but is slightly smaller than the base 36 of the base unit 4 to allow free rotation therein. As seen in FIG. 10, the floor of the base 13 proximate the neck 18 may, in some embodiments, be defined by one or more drain holes 91 to allow drainage from the concave hollow of the base 36 into the base unit 4 for improved sanitation and easy cleaning. In embodiments lacking said drain holes 91 the concave floor of the base 13 itself serves to capture and collect residue.

Figure 12:
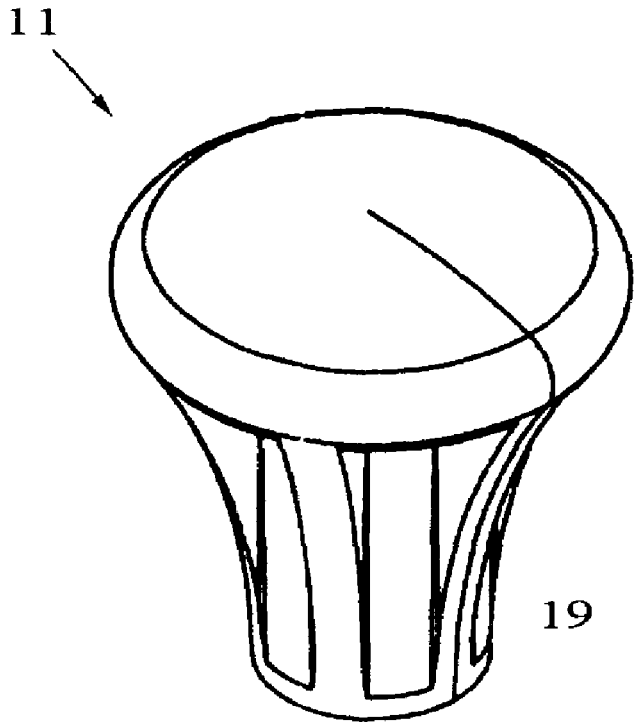
FIGS. 12 and 13 are perspective and cross-sectional views, respectively of the knob 11.
Figure 13:
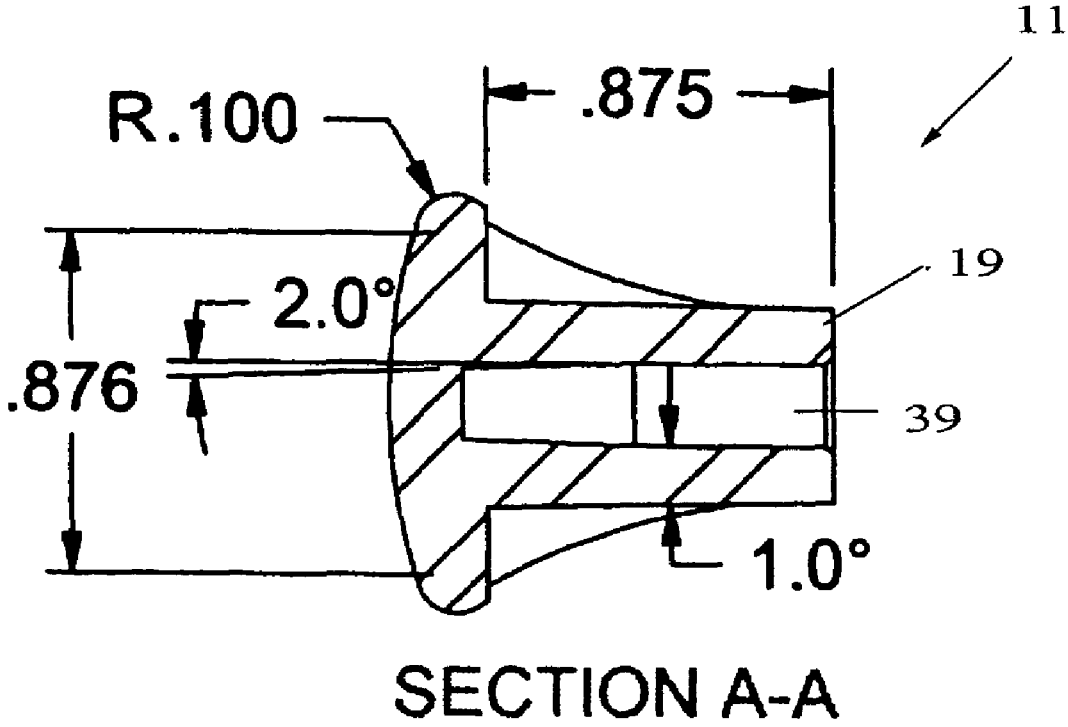

FIGS. 12 and 13 are perspective and cross-sectional views, respectively of the knob 11. The knob 11 may take various aesthetic design forms and generally comprises a rounded top connected to tapered body 19 to facilitate ease of grasping and turning. The radius of the top is approximately 0.1 inches. The length of the knob 11 may be 0.875 inches. The body 19 is defined by a tapped hole 39 running axially into the body 19 to receive the threaded screw 16 of rod 12. The diameter of the tapped hole 39 conforms in diameter to the threaded rod 16, thereby allowing the rod 12 to remain securely connected within the hole 39.

Figure 14:
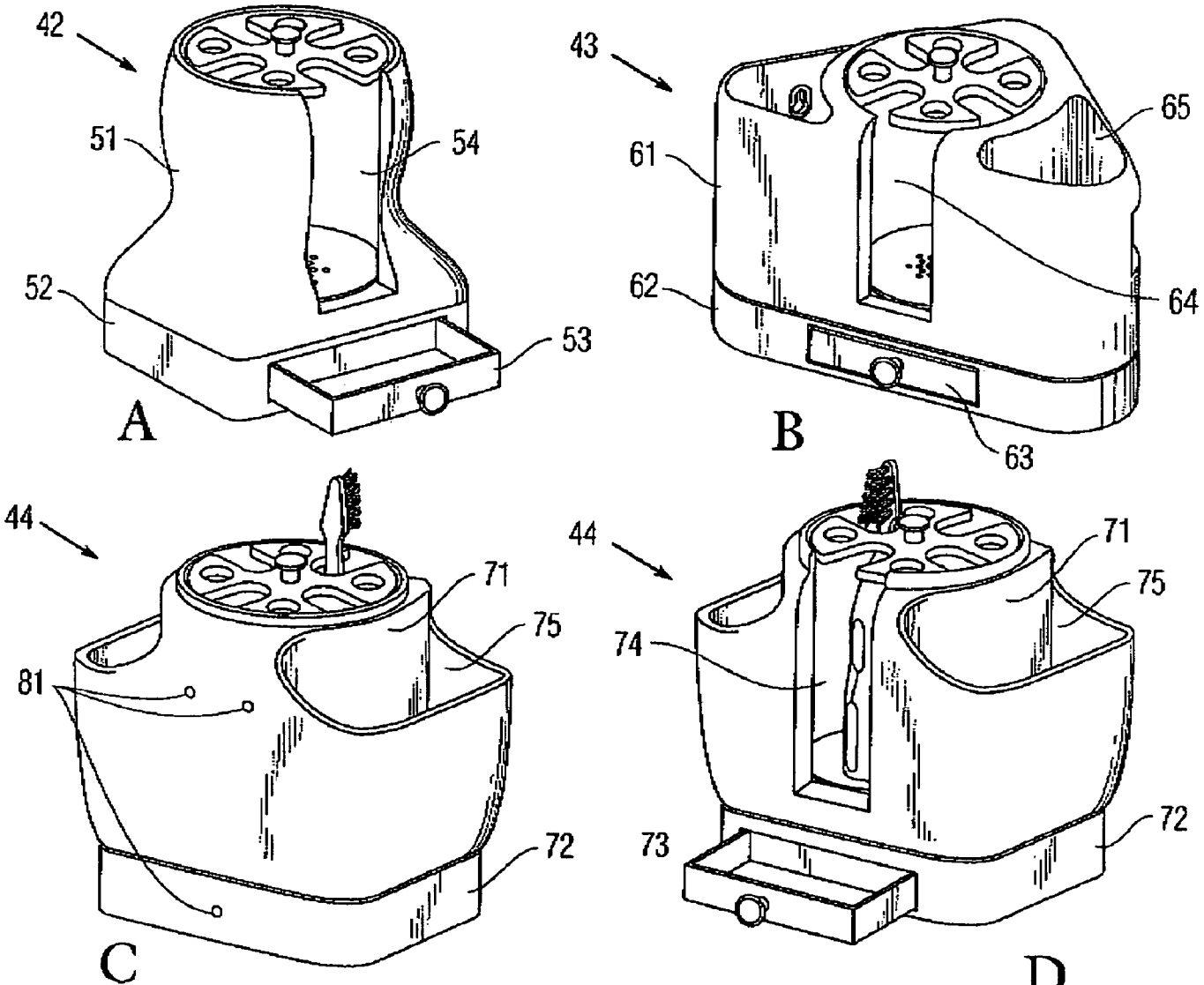
FIG. 14(A-D) is a compilation of various alternative embodiments 42-44 of the base 4 of FIGS. 1-2.

FIG. 14 (A-D) is a compilation of various alternative embodiments 42-44 of the base 4 of FIGS. 1-2, all generally comprising a hollow open-topped upper section for rotatably housing the rotary dispenser 2 of FIG. 2. FIG. 14A shows a base 42 having a generally cylindrical upper section 51 flaring into a rectangular bottom section 52. A drawer 53 is slidably inserted into the bottom section 52. The drawer 53 lies directly underneath the drain holes 91 in the floor of the base 13 to collect drainage from the concave hollow of the base 36, and to allow easy cleaning. The enlarged bottom section 52 allows the unit to stand upright on a bathroom counter or other flat surface.

FIG. 14B shows a corner-unit base 43 having a generally triangular upper section 61 integrally joined to a like bottom section 62. Again a drawer 63 is slidably inserted into the bottom section 62 for removal of drainage. The triangle shape of base unit 43 leaves space for side receptacles 65 which provide additional storage for items such as toothpaste, cosmetics, hair accessories, and other small bath and beauty items. The triangular-shaped base unit 43 may be placed on a bathroom counter or other flat surface, and particularly in a corner for maximum utilization of counter or surface space.

FIGS. 14C-D are rear and front perspective views, respectively, of a base 44 having a generally cylindrical upper section 71 flaring into a rectangular bottom section 72. A drawer 73 is slidably inserted into the bottom section 72. In addition, base 44 is formed with rounded side receptacles 75 formed on flanking sides of the base 44. The rounded side receptacles 75 provide additional storage for items such as toothpaste, cosmetics, hair accessories, and other small bath and beauty items.

In the embodiments of FIG. 14 holes 81 may be drilled into one rear side of the base (see FIG. 14C) so that the base can be hung via hooks or protruding screws on a wall. Alternately, the base may rest flat on a bathroom counter or other flat surface.

Figure 15:
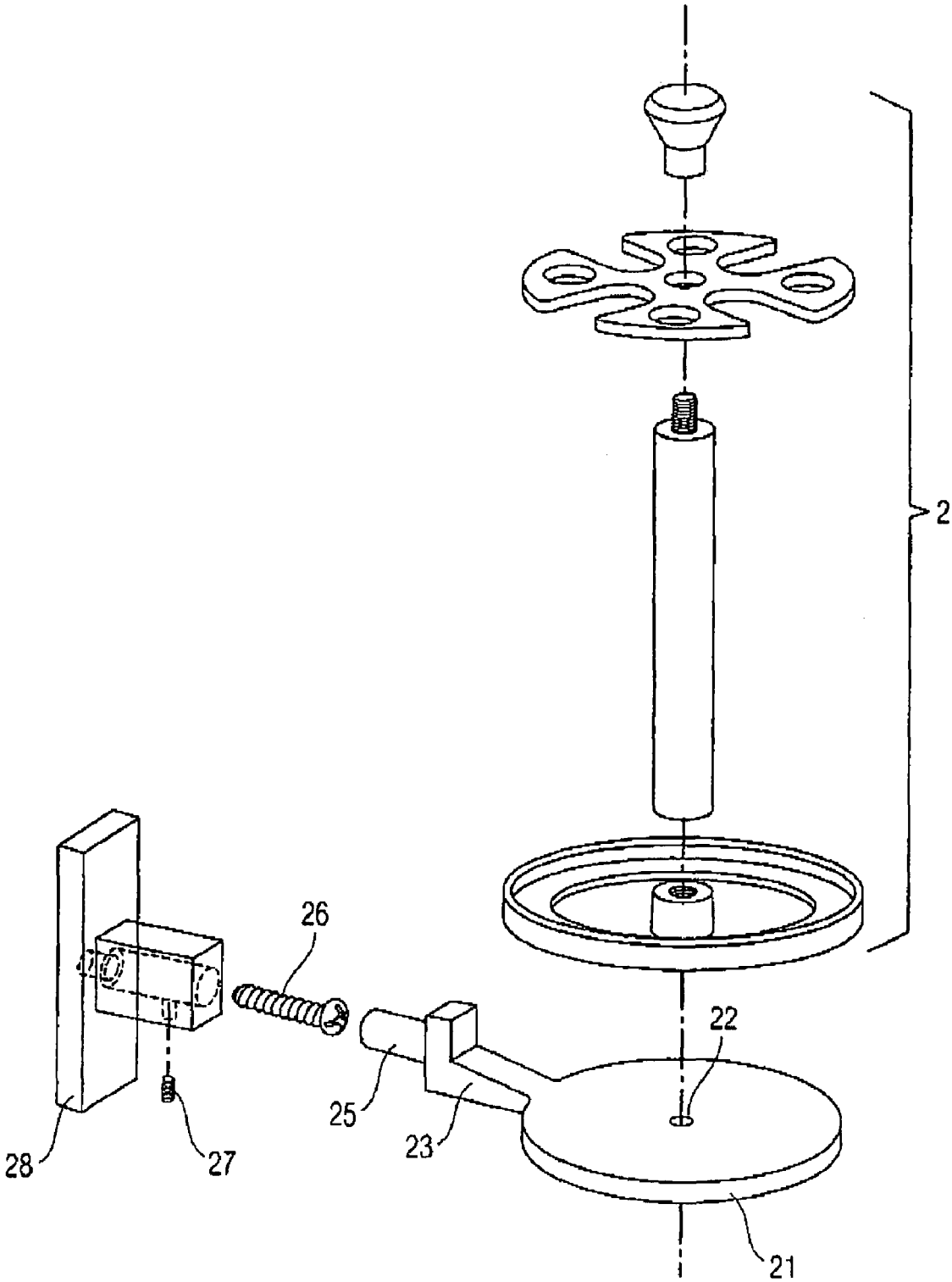
FIG. 15 is an exploded view of a wall-mount assembly 20 for supporting the same rotary dispenser 2 on a wall.

As an alternative to the freestanding units described above, FIG. 15 is an exploded view of a wall-mount assembly 20 for supporting the same rotary dispenser 2 on a wall or other flat vertical surface. The wall-mount 20 comprises a planar circular plate 21 with a centrally defined aperture 22, and an extension 23 attached integrally to the side of the plate 21. The extension 23 comprises an L-shaped block attached to the plate 21. The extension 23 protrudes rearwardly to a finger 25 that is inserted into a vertical mounting bracket 28 secured to a wall. Vertical mounting bracket 28 may be adhered or screwed into the wall. The vertical mounting bracket 28 is defined by an axial through-bore to allow screw 26-securement of the vertical mounting bracket 28 into the wall. In addition, vertical mounting bracket 28 is also defined by a vertical threaded bore to allow a set screw 27 to be inserted up through wall mount bracket 28 to engage the finger 25 of extension 23 for securement to the wall mounting bracket 28 and to prevent withdrawal.

The wall mount assembly 20 can be integrally molded of rigid plastic by injection molding. The screws 24, 26, 27 are preferably stainless steel to avoid rust. However, one skilled in the art will understand that any materials possessing an appropriate amount of flexibility, resiliency, durability, and longevity may be used.

In all the above-described embodiments, the carousel provides a practical solution that offer consumers a clean, conveniently placed storage solution for one or more bulky electric toothbrushes alone, or in combination of conventional manual toothbrushes, that facilitates more sanitary and convenient storage solution for a family of adults as well as children. With the toothbrushes stored in the clover disc 5, the carousel drains and catches water and residue runoff in the base 4 and 42-44 thereby reducing cross-contamination. Moreover, the carousel has a highly attractive aesthetic appearance and provides intriguing queued rotational-access to the toothbrushes stored therein.

The dimensions of the carousel may be easily scaled in size to fit various toothbrush 37 dimensions. While relative dimensions and measurements set forth herein are important, the absolute dimensions are for illustrative purposes only and one skilled in the art will understand that the variations in size, shape, materials, form, use, assembly, and manner of operation are within the scope of the invention.

In use, the rotary dispenser 2 is seated atop the wall-mount assembly 20 by seating it atop the plate 21 of the wall-mount 20, and threading screw 24 up into the aperture 22 in the plate 21 and then through aperture 19 of the base 13, and on into the rod 12. The wall bracket 28 is securely attached to the wall. The rotary spindle-type dispenser 2 remains free to revolve on plate 21, holding one or more electric toothbrushes plus standard toothbrushes 37 in a convenient, easily reachable, queued position. Again, spindle-type dispenser 2 is designed especially to accommodate the wide base of the electric toothbrush which houses internal batteries and internal mechanics.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

We claim:

1. A universal electric toothbrush carousel comprising:

a rotary dispenser including, a disc formed with a broken arcuate edge, a plurality of radially-spaced apertures through said disc, and a corresponding plurality of U-shaped recesses opening peripherally into the edge of said disc, said U-shaped recesses being interspaced between said apertures for holding electric toothbrushes captive therein, a knob mounted atop said disc, a concave base offset from said disc and defining an upwardly concave floor facing said disc for standing and inclining said electric toothbrushes into the U-shaped recesses in said disc, and a rod attached at one end centrally beneath said disc and at another end centrally to the floor of said concave base, said concave base also having a downwardly protruding annular lip for rotatably seating the rotary dispenser; and a substantially enclosed open-topped base unit comprising a bottom and cylindrical sidewalls surrounding a central compartment for rotatably seating said rotary dispenser therein, the sidewalls of said base covering and rotatably constraining both the disc and concave base of said rotary dispenser when said rotary dispenser is rotatably seated in said base unit, and said base unit being further defined by a vertically extending slot for access to electric toothbrushes held captive in the U-shaped recesses of the disc of said rotary dispenser;

whereby said rotary dispenser revolves within said base unit to hold and dispense electric toothbrushes as well as standard toothbrushes in queued positions.

2. The toothbrush assembly according to claim 1, wherein said rotary dispenser revolves within said base unit upon turning of said knob to queue a toothbrush into said slot.

3. A universal electric toothbrush carousel according to claim 1, wherein said base unit is formed with feet for allowing said carousel to stand freely.

4. A universal electric toothbrush carousel according to claim 1, wherein the bottom of said base unit is perforated to provide drainage.

5. A universal electric toothbrush carousel according to claim 1, wherein the bottom of said base unit is not perforated to contain drainage.

6. A universal electric toothbrush carousel according to claim 4, wherein said base unit further comprises a sliding drawer for accumulating drainage.

7. A universal electric toothbrush carousel according to claim 1, wherein said disc is formed with four radially-spaced apertures there through, and four shaped recesses opening outward from the sides of said disc.

8. A universal electric toothbrush carousel according to claim 7, wherein said disc is approximately 0.250 inches thick.

9. A universal electric toothbrush carousel according to claim 7, wherein a radius of curvature of each U-shaped recess toward a center of said disc is approximately 0.313 inches.

10. A universal electric toothbrush carousel according to claim 9, wherein opposing edges of each of said U-shaped recess flare outward at approximately 14 degrees to an opening from the disc.

11. A universal electric toothbrush carousel according to claim 7, wherein the apertures in said disc are circular with approximately one inch diameter.

* * * * *